United States Patent [19]

Wiczer et al.

[11] 4,437,664

[45] Mar. 20, 1984

[54] PIN BALL GAME WITH OSCILLATING SHOOTER

[75] Inventors: Max Wiczer, Skokie; Albin Peters, Chicago, both of Ill.

[73] Assignee: Wico Corporation, Niles, Ill.

[21] Appl. No.: 326,172

[22] Filed: Nov. 30, 1981

[51] Int. Cl.[3] ..... A63F 7/02; A63F 7/26

[52] U.S. Cl. ..... 273/121 A; 273/129 V

[58] Field of Search ..... 273/119 A, 121 A–125 A, 273/179 A, 129 V, 129 S

[56] References Cited

U.S. PATENT DOCUMENTS

| | | | |
|---|---|---|---|
| 497,307 | 5/1893 | Chipman . | |
| 512,104 | 1/1894 | Fishel . | |
| 1,023,176 | 4/1912 | Schuster . | |
| 1,385,677 | 7/1921 | Gillette . | |
| 2,024,851 | 12/1935 | Frohne | 273/121 A |
| 2,043,677 | 6/1936 | Salomon . | |
| 2,048,915 | 7/1936 | Bayer . | |
| 2,109,639 | 3/1938 | Hawley . | |
| 2,130,050 | 9/1938 | Walters . | |
| 2,196,549 | 4/1940 | Colaluca . | |
| 2,245,949 | 6/1941 | Williams et al. . | |
| 2,248,596 | 7/1941 | Wilsey . | |
| 2,610,058 | 9/1952 | Hooker | 273/121 A |
| 2,642,058 | 6/1953 | Murphy . | |
| 2,715,531 | 8/1955 | Henry . | |
| 2,910,296 | 10/1959 | Irwin . | |
| 3,140,093 | 7/1964 | Singer . | |
| 3,310,311 | 3/1967 | Peeples . | |
| 3,467,378 | 9/1969 | English et al. | 273/179 A X |
| 3,588,110 | 6/1971 | Hirsch | 273/129 V |
| 3,647,213 | 3/1972 | Baker . | |
| 3,656,753 | 4/1972 | Juneau . | |
| 3,807,735 | 4/1974 | Barlow . | |
| 3,834,706 | 9/1974 | Leonhart . | |
| 3,866,917 | 2/1975 | Ensmann et al. . | |
| 3,901,511 | 8/1975 | Garbark . | |
| 3,997,163 | 12/1976 | Cooper et al. . | |
| 4,130,280 | 12/1978 | Lowell . | |
| 4,132,411 | 1/1979 | Breslow et al. . | |

OTHER PUBLICATIONS

Circular of J. F. Frantz Division of Johnston Products Co., for Target Game.

*Primary Examiner*—Paul E. Shapiro

*Attorney, Agent, or Firm*—Dithmar, Stotland, Stratman & Levy

[57] ABSTRACT

A pin ball game includes a ball receptacle which has associated therewith a rotary oscillating shooter for propelling the ball from the receptacle and along the playfield board in the direction of a predetermined axis which oscillates with the shooter. When the ball drops into the receptacle it actuates a drive motor for oscillating the shooter and enables a manually-operated trigger switch. When the shooter axis is pointing in the desired direction, the user manually operates the trigger switch to actuate the shooter, which in turn operates to stop the shooter oscillation and disable the trigger switch.

18 Claims, 10 Drawing Figures

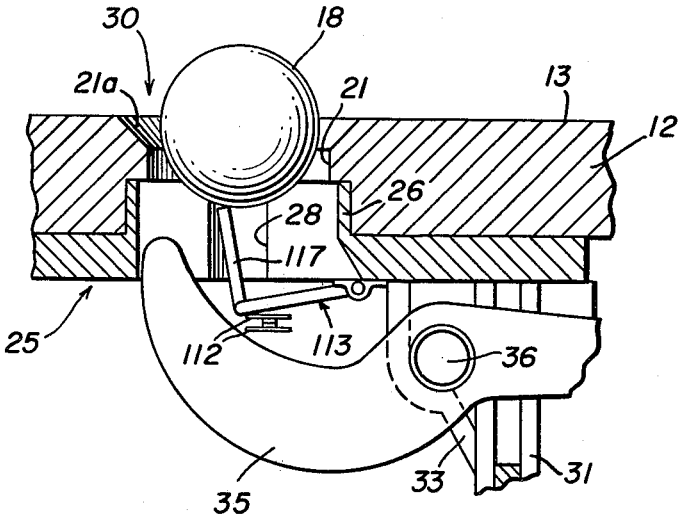
FIG. 7
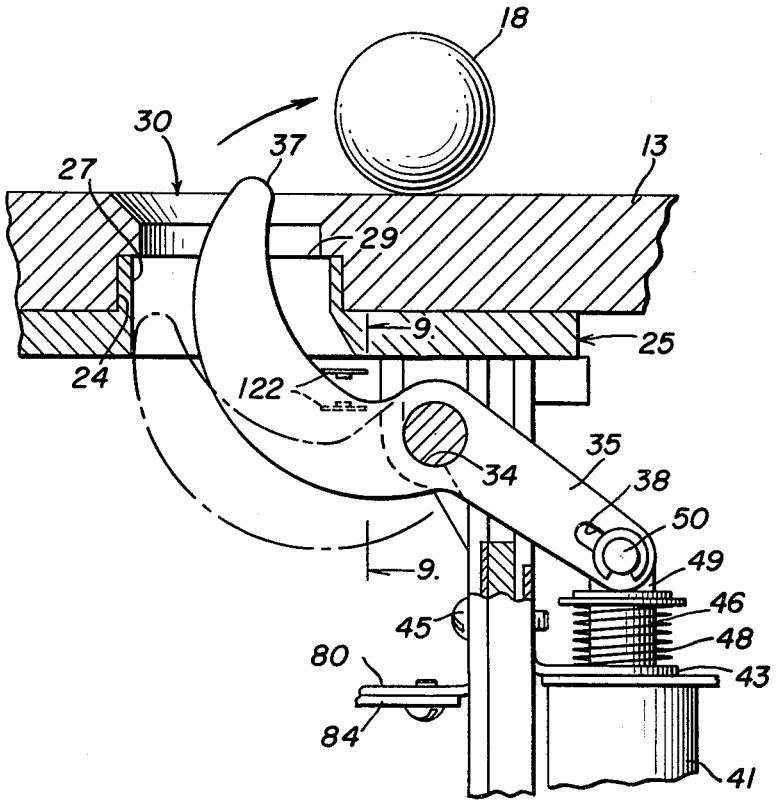
FIG. 8
FIG. 9
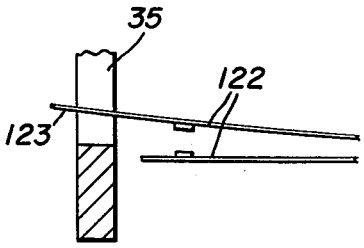

PIN BALL GAME WITH OSCILLATING SHOOTER

BACKGROUND OF THE INVENTION

The present invention relates to pin ball games, and, in particular, to apparatus for introducing the ball into play in a pin ball game.

In the standard mechanical pin ball game, a ball is introduced into play by means of a manually retractable, spring-biased shooter pin which propels the ball along a guide track to the field of play Certain versions of balltype games provide a manually aimable ball shooter, so that the direction as well as the speed of the ball can be controlled as it enters the field of play. Examples of such games are pin ball games, pistol-type target games, pool games and bowling games.

However while such prior games may provide electromechanical or electronic display or scoring devices, introduction of the ball into play is fundamentally manual. It is known to provide pin ball games with pockets or receptacles into which a ball may fall, the pockets being provided with ejector mechanism for automatically ejecting the ball from the pocket to reintroduce it into the field of play. However, in such mechanisms the direction in which the ball is ejected from the pocket is fixed, and there is no element of skill involved. Such an arrangement is illustrated, for example, in U.S. Pat. No. 3,901,511.

SUMMARY OF THE INVENTION

The present invention relates to an improved pin ball game and apparatus for introducing a pin ball into play in a pin ball game.

It is an important object of this invention to provide ball control apparatus for a pin ball game which provides automatic and electronic elements in the introduction of the ball into play, while permitting the player to control the direction in which the ball enters the field of play.

It is another object of this invention to provide a ball control apparatus of the type set forth which includes ball propelling means which automatically sweeps across a range of ball directions, and wherein the player selectively actuates the ball propelling means when it is aimed in the desired direction.

Another object of this invention is the provision of ball control apparatus of the type set forth wherein the apparatus is actuated by return of the ball thereto.

Still another object of this invention is to provide a pin ball game incorporating the ball control apparatus.

The invention consists of certain novel features and the combination of parts hereinafter fully described, illustrated in the accompanying drawings and particularly pointed out in the appended claims, it being understood that various changes in the details may be made without departing from the spirit, or sacrificing any of the advantages, of the invention.

These objects are achieved by providing ball propelling means having a propulsion axis for propelling the ball into rolling engagement with the playfield board along said axis, and automatic direction control means for moving said axis continually through a predetermined range of movement for varying the direction in which the ball may be propelled along the playfield board.

BRIEF DESCRIPTION OF THE DRAWINGS

FIG. 7 is a fragmentary view in vertical section of a portion of the apparatus illustrated in FIG. 3, showing the position of the apparatus when a ball has been received in the ball pocket;

FIG. 8 is a view similar to FIG. 7, illustrating the ejection of the ball from the pocket;

FIG. 9 is a fragmentary view in vertical section taken along the line 9—9 in FIG. 8.

DESCRIPTION OF THE PREFERRED EMBODIMENT

Figure 1:
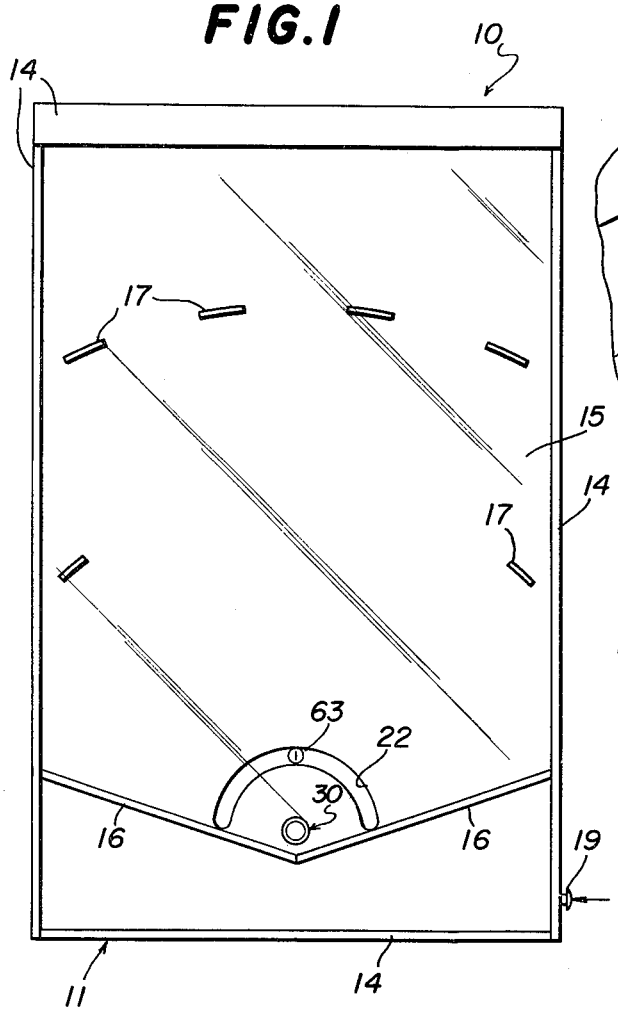
FIG. 1 is a top plan view of a pin ball game constructed in accordance with and embodying the features of the present invention.

Referring to FIG. 1 of the drawings, there is illustrated a pin ball game, generally designated by the numeral 10 including a housing 11 enclosing a playfield board 12 having an upper surface 13. The housing 11 is generally rectangular and includes four peripheral side walls 14 bounding the playfield board 12 and supporting a glass cover 15 which is spaced a predetermined distance above the playfield board 12. The pin ball game 10 includes a pair of guide rails 16 projecting above the playfield board 12 and cooperating to extend thereacross, the guide rails 16 converging toward the lower end of the playfield board 12 centrally thereof. A plurality of targets 17 may also be provided on the playfield board 12 for engagement by a pin ball 18 which rolls along the playfield board 12. A control button 19 may be provided on the housing 11 for a purpose to be explained more fully below.

Figure 2:
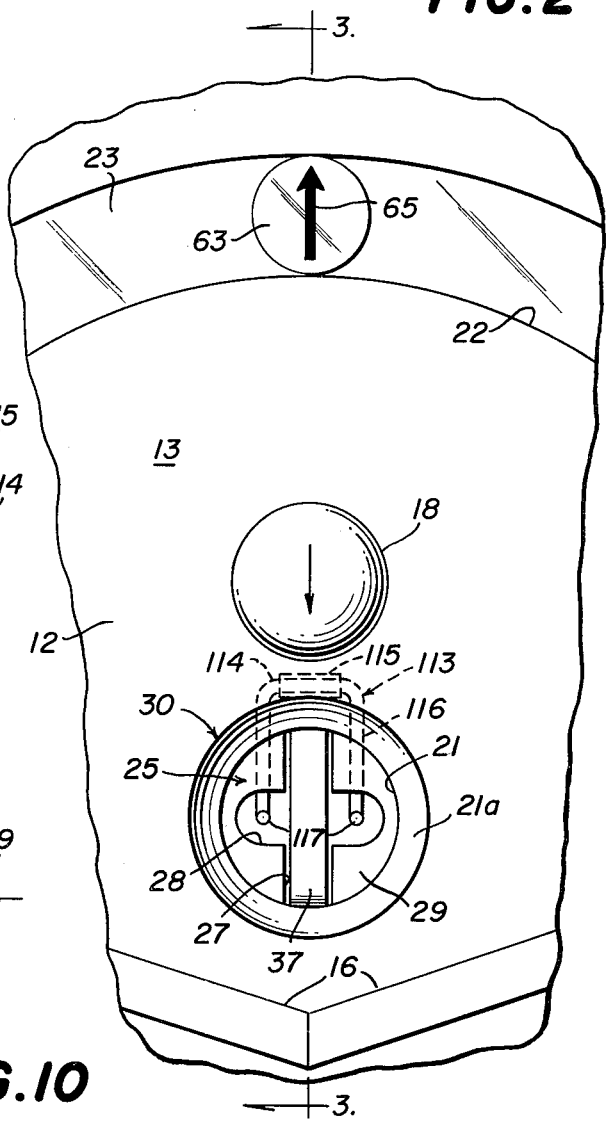
FIG. 2 is an enlarged fragmentary top plan view of the portion of the pin ball game incorporating the ball control apparatus of the present invention, with the apparatus illustrated in an intermediate position in its range of movement.
Figure 3:
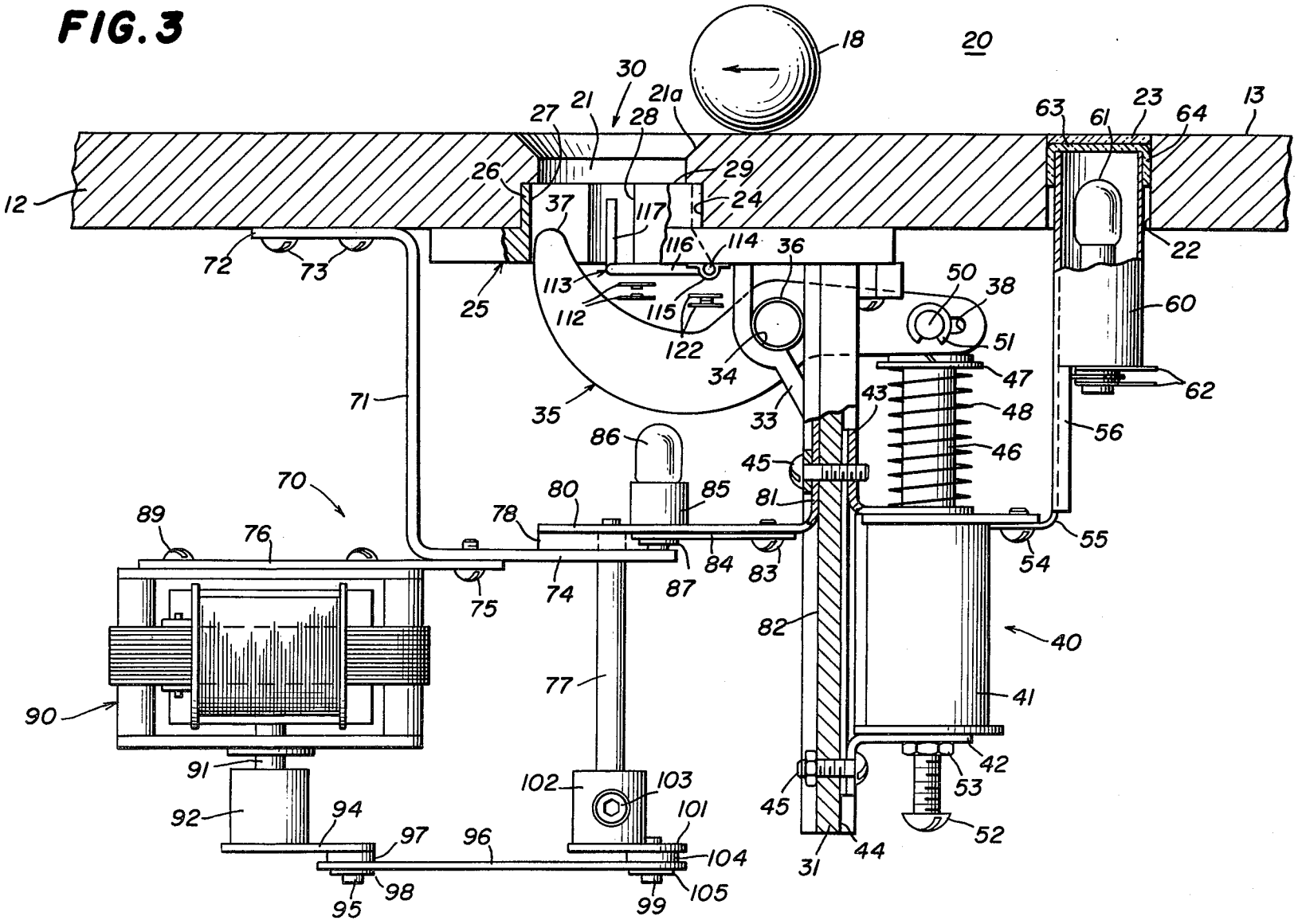
FIG. 3 is a fragmentary view in vertical section taken along the line 3—3 in FIG. 2 and illustrating the ball control apparatus of the present invention.

Referring also to FIGS. 2 and 3, the pin ball game 10 includes ball a control apparatus or shooter, generally designated by the numeral 20, for introducing the ball 18 into play. In this regard, the playfield board 12 has a circular opening 21 formed therethrough adjacent to the intersection point of the guide rails 16, and having a beveled upper edge **21*a*, the outer rim of which is spaced from the guide rails 16 a distance less than the radius of the pin ball 18. The opening 21 has a diameter slightly greater than that of the pin ball 18. Also formed through the playfield board 12 coaxially with the circular opening 21 is an arcuate opening 22, the ends of which are respectively disposed adjacent to the guide rails 16. The arcuate opening 22 is covered by a transparent cover 23, (see FIG. 3**) which may be formed of plastic or the like, and has the upper surface thereof disposed substantially coplanar with the upper surface 13 of the playfield board 12 to afford smooth uninterrupted rolling of the pin ball 18 across the arcuate opening 22.

The circular opening 21 has an enlarged-diameter lower portion 24. Disposed beneath the playfield board 12 is a ball support, generally designated by the numeral 25, which is provided with an upstanding cylindrical portion 26 which is disposed in the enlarged lower portion 24 of the circular opening 21 coaxially therewith. The cylindrical portion 26 has two elongated slots 27 and 28 extending vertically therethrough, and each disposed diametrically with respect to the cylindrical portion 26 and perpendicular to each other. The slot 27 has a length at least as great as the diameter of the upper portion of the circular opening 21, while the slot 28 has a length less than the diameter of the upper portion of the circular opening 21 and is provided with arcuate ends (see FIG. 2). The upper end of the cylindrical portion 26 defines a flat surface 29 disposed in use substantially parallel to the upper surface 13 of the playfield board 12 a predetermined distance therebelow for cooperation with the circular opening 21 to define a pocket or receptacle 30 for the pin ball 18.

The ball support 25 is rotatably movable with respect to the playfield board 12 and is fixedly secured to the upper end of an elongated upstanding frame 31. Projecting upwardly and outwardly from the frame 31 are a pair of spaced-apart pivot arms 33, the upper ends of which are fixedly secured to the ball support 25, and each of which is provided with an arcuate bearing surface 34.

An elongated kicker 35 extends between the pivot arms 33 and through a complementary slot in the upper end of the frame 31, the kicker 35 being provided intermediate its ends with a pivot shaft 36, the opposite ends of which are respectively rotatably received between the bearing surfaces 34 and the adjacent surfaces of the frame 31. The kicker 35 has a curved, upwardly projecting engagement tip 37 which extends into the slot 27 in the ball support 25. The other end of the kicker 35 has an elongated slot 38 therethrough to facilitate coupling to a kicker solenoid, generally designated by the numeral 40. More specifically, the kicker solenoid 40 includes a coil 41 having fixedly secured thereto lower and upper brackets 42 and 43, each having a flange receivable in a channel 44 formed in the adjacent side of the frame 31 and fixedly secured thereto, as by threaded fasteners 45.

The solenoid 40 has a plunger rod 46 projecting upwardly therefrom and provided at the upper end thereof with a retainer 47. Disposed in surrounding relationship with the plunger rod 46, and confined between the upper bracket 43 and the retainer 47, is a helical compression spring 48, resiliently urging the plunger rod 46 upwardly to the position illustrated in FIG. 3 in the normal, de-energized condition of the solenoid 40. Secured to the plunger rod 46 at the upper end thereof is a coupling pin 49 (see FIG. 8) which is pivotally coupled to a pivot pin 50 which extends through the slot 38 in the kicker 35 and is retained in place thereon by a retainer 51, such as an E-ring. The solenoid 40 may also be provided with an adjusting screw 52 and nut 53 for the plunger rod 46. It will be noted that in the de-energized condition of the solenoid 40, the engagement tip 37 of the kicker 35 projects upwardly a slight distance into the slot 27, but is disposed beneath the level of the upper surface 29 of the ball support 25.

Fixedly secured to the kicker solenoid 40, as by threaded fasteners 54, is a bracket 55 provided with an upstanding support flange 56 on which is mounted a cylindrical lamp housing 60 which projects upwardly into the arcuate opening 22 in the playfield board 12. Mounted in the lamp housing 60 is a socket (not shown) carrying a lamp bulb 61, the socket being provided with terminals 62 for connection to associated electrical circuitry. The upper end of the lamp housing 60 is covered with a circular cover 63 which is preferably formed of transparent or translucent material and is provided with a cylindrical depending flange 64 disposed in telescoping surrounding relationship with the lamp housing 60. The cover 63 is provided with an indicium 65 (see FIG. 2) in the form of an arrow directed radially outwardly of the arcuate opening 22 to indicate the directicn in which the ball 18 will be ejected by the kicker 35 from the receptacle 30 as will be explained more fully below.

There is also provided a drive assembly, generally designated by the numeral 70, which includes a mounting bracket 71 having one flange 72 thereof fixedly secured, as by fasteners 73, to the underside of the playfield board 12, and having an attachment flange 74 fixedly secured, as by fasteners 75, to a motor support plate 76. Extending through a complementary opening in the attachment flange 74, coaxially with the receptacle 30, is an elongated cylindrical shaft 77. The upper end of the shaft 77 projects a predetermined distance above the attachment flange 74 and is fixedly secured to a coupling plate 80, which is spaced a predetermined distance above the attachment flange 74 substantially parallel thereto by an annular spacer 78. The coupling plate 80 is provided with an upstanding flange 81 which is disposed in a complementary channel 82 formed in the adjacent surface of the frame 31 and fixedly secured thereto by the fasteners 45. Secured to the underside of the coupling plate 80 as by a fastener 83 and projecting laterally therefrom is an elongated lamp arm 84, supporting at the distal end thereof a socket 85 for a lamp bulb 86, the socket 85 being provided with a terminal 87 for connection to associated electrical circuitry. The bulb 86 is positioned so as to illuminate the receptacle 30 through the slots 27 and 28 in the ball support 25.

Referring also to FIGS. 4–9, there is fixedly secured to the motor support plate 76, as by threaded fasteners 89, an electric motor 90 having an output shaft 91. A bushing 92 is fixedly secured to the distal end of the shaft 91, as by set screws 93 (see FIG. 4), the bushing 92 being integral with one end of a crank arm 94, the other end of which is provided with a pin 95 received in a complementary opening in one end of a connecting rod 96. A spacer 97 is disposed in surrounding relationship with the pin 95 between the crank arm 94 and the connecting rod 96, the latter being retained in place by a retainer 98, such as an E-ring. Received through a complementary opening in the other end of the connecting rod 96 is a pin 99, which is also received through a complementary opening 100 (FIG. 4) in one end of a crank arm 101, the other end of which is integral with a bushing 102 secured as by set screws 103 to the lower end of the shaft 77. A spacer 104 is disposed in surrounding relationship with the pin 99 between the connecting rod 96 and the crank arm 101, the pin 99 being retained in place by one or more retainers 105, which may be in the form of E-rings. The opening 100 in the crank arm 101 may be elongated (see FIG. 4) to provide necessary lost motion in the linkage. In the same manner lost motion slots could be provided at other points in the linkage, if necessary.

A ball switch 110 is fixedly secured, as by fasteners 111, to the ball support 25. The ball switch 110 is provided with a pair of elongated leaf contacts 112 which extend to a position immediately beneath the cylindrical portion 26 of the ball support 25 (see FIGS. 3 and 7). Also disposed beneath the ball support 25 is a ball switch actuator, generally designated by the numeral 113 which has a generally U-shaped base, including a bight portion 114 secured to the underside of the ball support 25 by a spring support member 115, and a pair of spaced-apart arms 116, respectively provided at the distal ends thereof with upstanding fingers 117 which are respectively disposed in the opposite ends of the slot 28 in the ball support 25. The actuator 113 is normally resiliently urged by the spring support member 115 to the position illustrated in FIG. 3, disposed against the underside of the ball support 25. In this position, the upper ends of the fingers 117 are disposed for engagement by a ball 18 when it drops into the receptacle 30, for pivoting the actuator 113 downwardly and closing the contacts 112 of the ball switch 110, as illustrated in FIG. 7. There is also provided a kicker switch 120 which is fixedly secured, as by fasteners 121, to the ball support 25. The kicker switch 120 is provided with a pair of elongated leaf contacts 122, the upper one of which has an extension 123 (see FIGS. 3 and 9) which projects above the kicker 35.

Figure 10:
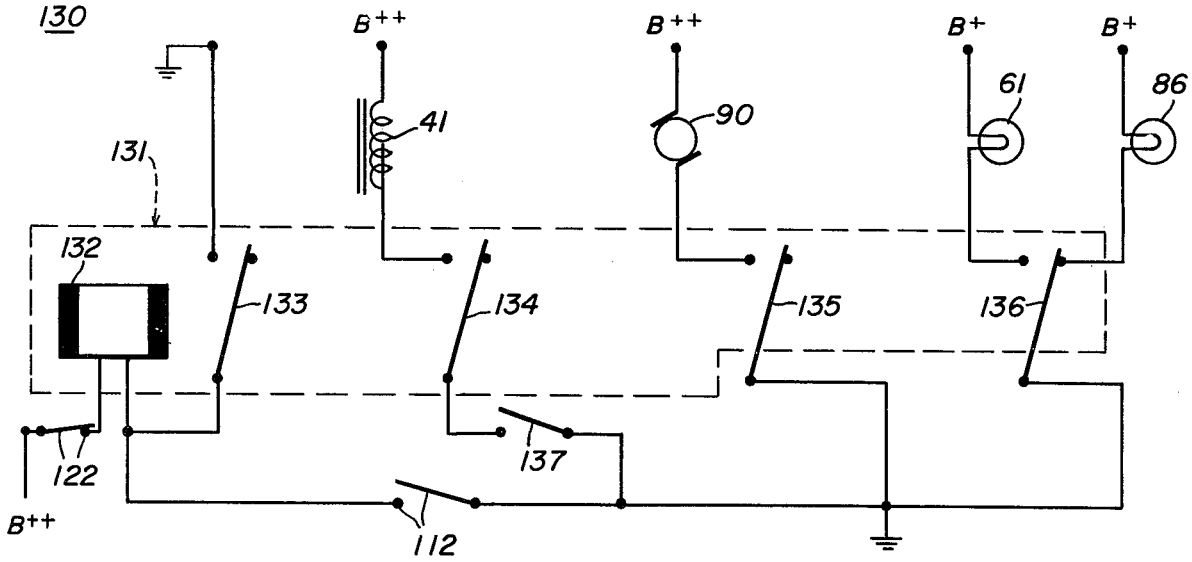
FIG. 10 is a schematic circuit diagram of the electrical control circuit of the present invention.

Referring now also to FIG. 10 of the drawings, the ball control apparatus 20 is provided with an electrical control circuit 130 which includes a relay, generally designated by the numeral 131. The relay 131 has a coil 132, one terminal of which is connected to a positive AC supply, designated B++, through the normally-closed contacts 122 of the kicker switch 120. The other terminal of the coil 132 is connected to ground through the parallel combination of the normally-open contacts 112 of the ball switch 110 and normally-open contacts 133 of the relay 131. The relay 131 is also provided with normally-open contacts 134 and 135 and double-throw contacts 136. The kicker solenoid coil 41 has one terminal thereof connected to the B++ supply and the other terminal thereof connected to ground through the series combination of the relay contacts 134 and a normally-open trigger switch 137, which is actuated by the push button 19. The motor 90 has one terminal thereof connected to the B++ supply and the other terminal thereof connected to ground through the relay contacts 135. The movable one of the relay contacts 136 is connected to ground, the associated fixed contacts of this relay pole being respectively connected to the indicator lamp bulb 61 and the illumination lamp bulb 86, which are in turn connected to a positive AC supply, designated B+. Preferably, the B++ supply is 30 VAC and the B+ supply is 6 VAC.

The operation of the ball control apparatus 20 will now be described in detail. Initially, the apparatus 20 is disposed in its normal rest condition, illustrated in FIGS. 2 and 3 of the drawings, and the control circuit 130 is disposed in its initial condition illustrated in FIG. 10. In this initial condition, the ball control apparatus 20 is at rest, the solenoid 40, the motor 90, the lamp bulb 61 and the relay 131 are de-energized, and the illumination lamp bulb 86 is energized for illuminating the receptacle 30. The playfield board 12 is preferably slightly inclined so that when a ball 18 is propelled thereonto, it tends to roll back down toward the guide rails 16 and is then guided thereby to the receptacle 30. When the ball 18 falls into the receptacle 30, it depresses the actuator 113 for closing the contacts 112 of the ball switch 110 (see FIG. 7), thereby to energize the relay coil 132. Upon energization of the relay 131, the contacts 133, 134 and 135 thereof close and the contacts 136 shift to de-energize the illumination lamp bulb 86 and energize the indicator lamp bulb 61. Closure of the relay contacts 133 serves to latch the relay 131 in its energized condition, thereby to prevent arcing of the ball switch contacts 112, which might result from vibration of the pin ball game 10, or bouncing of the ball 18 on the actuator 113.

Closure of the relay contacts 135 energizes the drive motor 90 for rotating the output shaft 91 thereof. This rotational movement is translated, by means of the linkage comprising the crank arms 94 and 101 and the connecting rod 96 to an oscillatory rotational movement of the shaft 77. This rotational movement of the shaft 77 effects a corresponding movement of the frame 31 through the coupling plate 80, this movement being transmitted by the frame 31 to the ball support 25 and the lamp housing 60.

Figure 4:
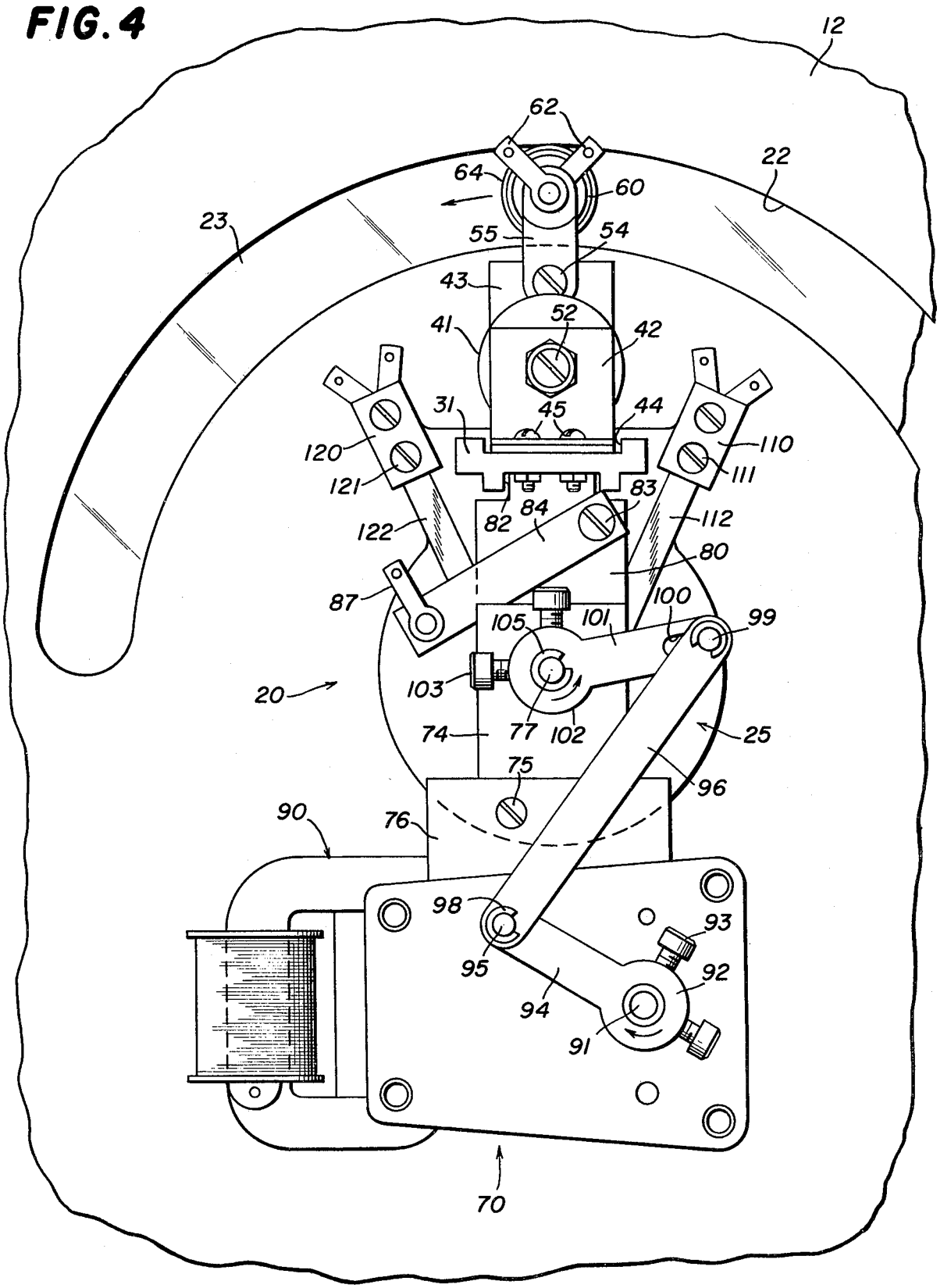
FIG. 4 is a fragmentary bottom plan view of the ball control apparatus illustrated in FIG. 3.
Figure 6:
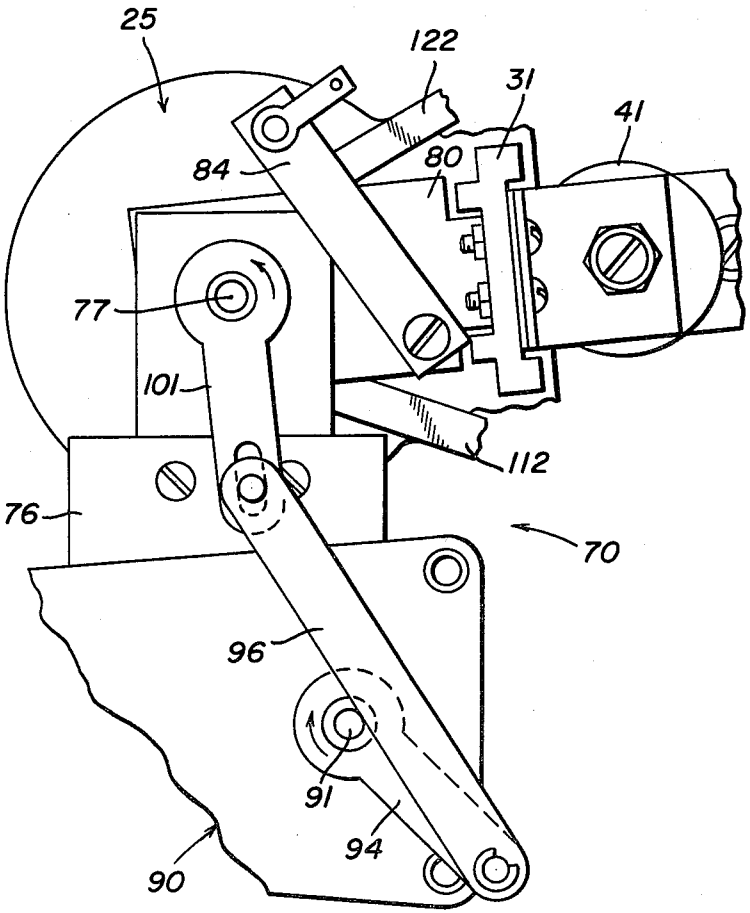
FIG. 6 is a view similar to FIGS. 4 and 5, and illustrating the apparatus at the other end of its range of movement.
Figure 5:
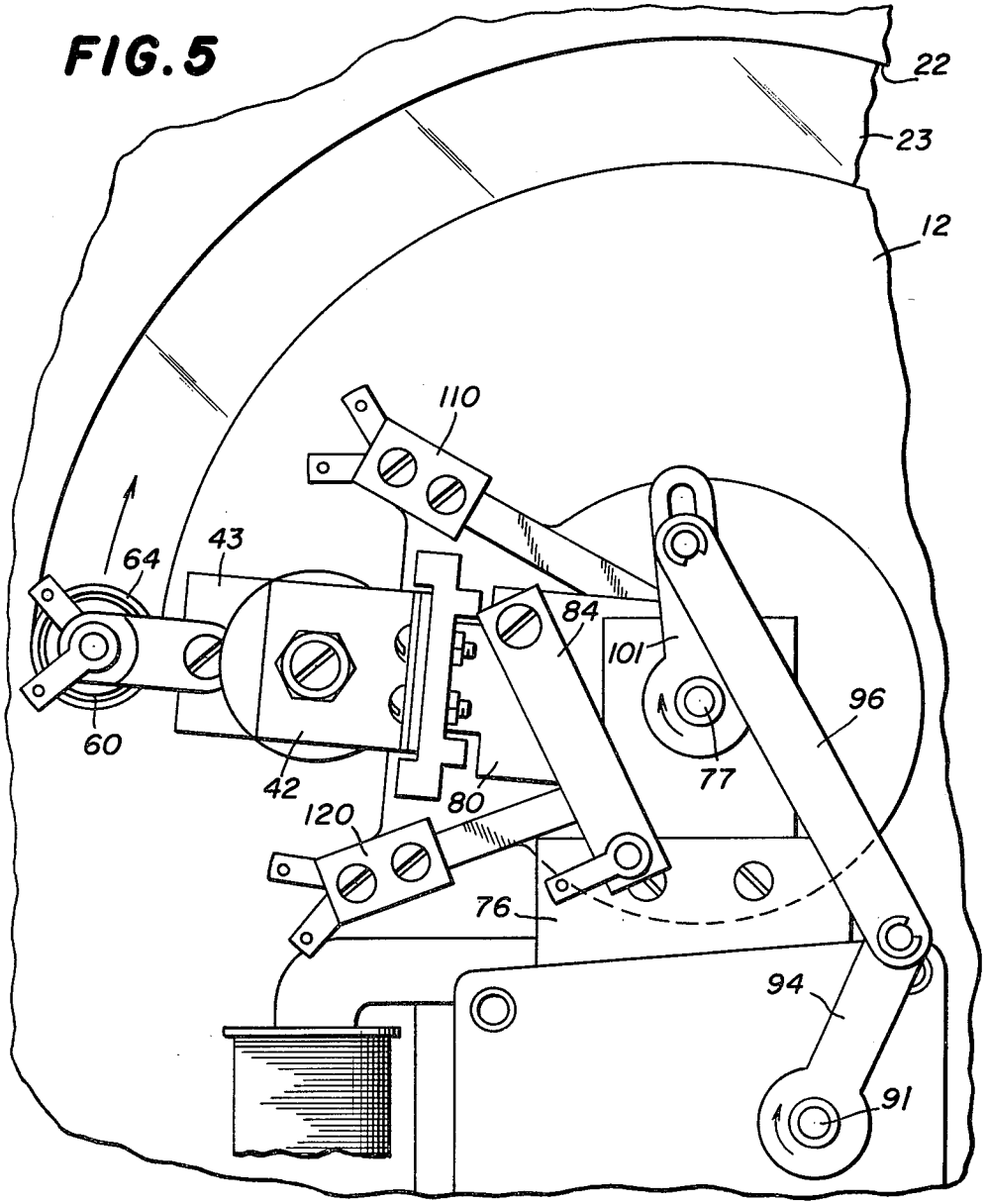
FIG. 5 is a fragmentary view similar to FIG. 4, and illustrating the apparatus at one end of its range of movement.

Referring to FIGS. 4 through 6 of the drawings, the motor shaft 91 rotates continuously in the direction of the arrow. Assuming that the motor 90 is energized when the ball control apparatus 20 is in the position illustrated in FIG. 4, the clockwise movement of the crank arm 94 will drive the connecting rod 96 upwardly, imparting a counterclockwise movement to the crank arm 101, thereby rotating the lamp housing 60 to the left along the arcuate opening 22, as indicated by the arrow in FIG. 4. Because it is coaxial with the shaft 77, the ball support 25 will rotate in the circular opening 21. When the longitudinal axis of the crank arm 94 and the connecting rod 96 are aligned, the frame 31 will have rotated to the limit of its range of movement, wherein the lamp housing 60 is disposed at the left-hand end of the arcuate opening 22, as indicated in FIG. 5.

Continued rotational movement of the crank arm 94 will pull the connecting rod 96 downwardly, rotating the connecting rod 96 in a clockwise direction, as viewed in FIG. 5, until, when the longitudinal axis of the crank arm 94 and the connecting rod 96 are again in alignment and overlapping, the frame 31 will have rotated back past the position illustrated in FIG. 4 to the other limit of its range of movement, wherein the lamp housing 60 is disposed at the right-hand end of the arcuate opening 22, the approach to this position being illustrated in FIG. 6. Continued rotation of the crank arm 94 will then again push the connecting rod 96 upwardly to drive the crank arm 101 back in a counterclockwise direction to repeat the cycle.

It will be appreciated that because of the fixed interconnection of the frame 31 and the ball support 25, the kicker 35 and the slot 27 in the ball support 25 and the indicating arrow 65 on the lamp cover 63 will always be in longitudinal alignment along a shooting or propulsion axis, which propulsion axis undergoes a rotational oscillatory movement with the frame 31 about the axis of the shaft 77. The kicker 35 is arranged so that its movement between its rest and shooting positions (see FIG. 8) is in a plane perpendicular to the playfield board which includes the propulsion axis, the kicker 35 being shaped and dimensioned so that when it is triggered to its shooting position it will engage a ball resting in the receptacle 30 so as to propel it into rolling engagement with the playfield board along the propulsion axis indicated by the arrow 65. It will be appreciated that the generally U-shaped configuration of the actuator 113 permits the kicker 35 to move between the arms 116 thereof without interferring with the actuator 113.

The closure of the relay contacts 134 enables the trigger switch 137 so that when the trigger switch 137 is closed by manual actuation of the button 19 by a player, the kicker solenoid coil 41 will be energized to pull the plunger rod 46 downwardly (see FIG. 8) against the urging of the compression spring 48, thereby to pivot the kicker 35 upwardly into engagement with the ball 18 in the receptacle 30 for propelling it from the receptacle 30 and along the playfield board in the direction of the propulsion axis indicated by the arrow 65. Thus, it will be appreciated that a user can selectively control the direction in which the ball 18 is shot by waiting until the propulsion axis indicating arrow 65 is pointing in the direction in which he wishes the ball to go and then actuating the kicker solenoid 40 to shoot the ball 18 in that direction. In this way, the player can selectively direct the ball 18 toward any one of the targets 17 on the playfield board 12.

When the kicker 35 is actuated and pivots upwardly to the shooting position illustrated in FIG. 8, it engages the extension 123 on the upper one of the kicker switch contacts 122 for opening those contacts (see FIG. 9), thereby de-energizing the solenoid coil 132, since the ball switch contacts 112 have already returned to their normally open condition upon ejection of the ball 18 from the receptacle 30. Upon de-energization of the solenoid 131, its contacts 133–136 return to their initial condition, thereby deactuating the motor 90 for stopping the rotation of the frame 31, disabling the trigger switch 137, de-energizing the indicator lamp bulb 61 and reenergizing the illumination lamp bulb 86. When the ball 18 returns to the receptacle 30, the ball control apparatus 20 is again energized in the manner described above for another shooting operation.

While the present invention has been disclosed in the environment of a pin ball game having a single ball control apparatus 20 for use with a single pin ball 18, it will be appreciated that this arrangement is purely for illustrative purposes and that any number of other arrangements could be utilized. Thus, the pin ball game 10 could include more than one ball control apparatus 20 and could be adapted for use with more than one pin ball 18. Furthermore, while in the preferred embodiment the oscillatory movement of the ball control apparatus is automatically initiated by the drop of the pin ball 18 into the receptacle 30, it will be appreciated that the directional variation of the present invention could also be selectively controlled by the player. Finally, while a rectangular arrangement for the pin ball game 10 has been disclosed, it will be understood that other shapes and configurations of the playfield board and targets could be utilized.

From the foregoing, it can be seen that there has been provided an improved pin ball game including automatically actuated and electrically controlled ball control apparatus which permits a player selectively to determine the direction in which a ball is shot onto the playfield board.

We claim:

1. Ball control apparatus for use in a pin ball game including a playfield board on which a pin ball rolls for engagement with one or more targets, said ball control apparatus comprising a frame mounted for rotational movement about a predetermined axis, receptacle means carried by said frame for rotation therewith and adapted for receiveing a ball coaxially with said axis, ball propelling means carried by said frame for rotation therewith and disposed for engagement with a ball disposed in said receptacle means, said ball propelling means being movable in a plane disposed substantially perpendicular to the playfield board for propelling the ball into rolling engagement with the playfield board along the intersection thereof with said plane, first drive means coupled to said frame for effecting continual rotational movement thereof through a predetermined range of movement thereby to vary the orientation of said plane and the direction in which the ball may be propelled along the playfield board, second drive means coupled to said ball propelling means for effecting propelling movement thereof in said plane, and control means coupled to said first and second drive means and including the first and second actuating means, said first actuating means being responsive to reception of a ball in said receptacle means for actuating said first drive means and for enabling said second actuating means, said second actuating means being selectively operable after enablement thereof for actuating said second drive means, said control means including deactuating means responsive to propelling movement of said ball propelling means in said plane for deactuating said first drive means and disabling said second actuating means.

2. A pin ball game comprising a playfield board having an opening therein for receiving a pin ball, and an elogated arcuate aperture therethrough arranged substantially coaxially with said opening, one or more targets carried by said playfield board, a pin ball adapted to roll along said playfield board for engagement with said targets, ball support means disposed beneath said opening for supporting said pin ball therein, ball propelling means associated with said playfield board and having a propulsion axis, said ball propelling means being engageable with said pin ball for propelling said ball from said opening into rolling engagement with said playfield board along said axis, automatic direction control means associated with said ball propelling means for effecting a continual oscillatory rotational movement of said propulsion axis about the axis of said opening through a predetermined range of movement for varying the direction in which said ball may be propelled along said playfield board, and indicating means disposed in said arcuate aperture and coupled to said direction control means for movement with said propulsion axis along said arcuate aperture to indicate the direction of said propulsion axis.

3. Ball control apparatus for use in a pin ball game including a playfield board on which a pin ball rolls for engagement with one or more targets, said ball control apparatus comprising receptacle means associated with the playfield board for receiving a pin ball therein, a rotatable frame, ball propelling means carried by said frame and associated with said receptacle means and having a propulsion axis, said ball propelling means being operable for propelling the ball from said receptacle means and into rolling engagement with the playfield board along said axis, drive means coupled to said frame for effecting continual rotational movement thereof through a predetermined range of movement for varying the orientation of said axis and the direction in which the ball may be propelled along the playfield board, and actuating means coupled to said drive means and responsive to reception of a ball in said receptacle means for actuating said drive means.

4. The ball control apparatus of claim 3, wherein said ball propelling means is selectively operable.

5. The ball control apparatus of claim 3, wherein said receptacle means is carried by said frame for rotation therewith.

6. The ball control apparatus of claim 3, wherein said receptacle means has an aperture therein for receiving said ball propelling means therethrough for engagement with a ball disposed in said receptacle means.

7. The ball control apparatus of claim 3, wherein said drive means effects an oscillatory rotational movement of said frame.

8. The ball control apparatus of claim 7, wherein said drive means includes a continuously rotatable electric drive motor, and linkage means interconnecting said drive motor and said frame for converting the continous rotational movement of said drive motor to an oscillatory movement of said frame.

9. The ball control apparatus of claim 3, wherein said ball propelling means is movable in a plane disposed substantially perpendicular to the playfield board for propelling the ball into rolling engagement with the playfield board along the intersection thereof with said plane.

10. Ball control apparatus for use in a pin ball game including a playfield board on which a pin ball rolls for engagement with one or more targets, said ball control apparatus comprising receptacle means associated with the playfield board for receiving a pin ball therein, a rotatable frame, ball propelling means carried by said frame and associated with said receptacle means and having a propulsion axis, said ball propelling means being operable for propelling the ball from said receptacle means and into rolling engagement with the playfield board along said axis, drive means coupled to said frame for effecting continual rotational movement thereof through a predetermined range of movement for varying the orientation of said axis and the direction in which the ball may be propelled along the playfield board, and control means including first actuating means responsive to reception of a ball in said receptacle means for acutating said drive means and second actuation means for actuating said ball propelling means.

11. The ball control apparatus of claim 10, wherein said control means is responsive to operation of said first actuation means for enabling said second actuation means.

12. The ball control apparatus of claim 11, wherein said control means includes deactuation means coupled to said ball propelling means and responsive to operation thereof for deactuating said drive means and disabling said second actuation means.

13. The ball control apparatus of claim 10, wherein said second actuation means is selectively operable.

14. Ball control apparatus for use in a pin ball game including a playfield board on which a pin ball rolls for engagement with one or more targets, said ball control apparatus comprising receptacle means associated with the playfield board for receiving a pin ball therein, a rotatable frame, ball propelling means carried by said frame and associated with said receptacle means and having a propulsion axis, said ball propelling means being operable for propelling the ball from said receptacle means and into rolling engagement with the playfield board along said axis, drive means coupled to said frame for effecting continual rotational movement thereof through a predetermined range of movement for varying the orientation of said axis and the direction in which the ball may be propelled along the playfield board, and control means including first actuation means for engergizing said drive means and latch means responsive to momentary operation of said first actuation means for maintaining said drive means energized and second actuation means for actuating said ball propelling means.

15. Ball control apparatus for use in a pin ball game including a playfield board on which a pin ball rolls for engagement with one or more targets, said ball control apparatus comprising receptacle means associated with the playfield board for receiving a pin ball therein, a rotatable frame, ball propelling means carried by said frame and associated with said receptacle means and having a propulsion axis, said ball propelling means being operable for propelling the ball from said receptacle means and into rolling engagement with the playfield board along said axis, drive means coupled to said frame for effecting continual rotational movement thereof through a predetermined range of movement for varying the orientation of said axis and the direction in which the ball may be propelled along the playfield board, control means including first actuation means for actuating said drive means and second actuation means for actuating said ball propelling means, and indicating means coupled to said control means for indicating the direction of said propulsion axis.

16. The ball control apparatus of claim 15, wherein said indicating means is carried by said frame for movement therewith.

17. The ball control apparatus of claim 15, and further including illumination means for illuminating said receptacle means.

18. The ball control apparatus of claim 17, wherein said control means includes switching means for normally maintaining said illumination means energized and responsive to operation of said first actuation means for deenergizing said illumination means and energizing said indicating means.

* * * * *